US005871025A

United States Patent [19]

Richter

[11] Patent Number: 5,871,025

[45] Date of Patent: Feb. 16, 1999

[54] WALKING STICK

[76] Inventor: Herbert Richter, Drosselweg 8, 75331 Engelbrand, Germany, 75331

[21] Appl. No.: 962,905

[22] Filed: Nov. 3, 1997

[30] Foreign Application Priority Data

Jul. 8, 1997 [DE] Germany ..... 297 11 976 U

[51] Int. Cl.[6] ..... A45B 3/02

[52] U.S. Cl. ..... 135/65; 135/66; 135/76; 135/72; 135/910

[58] Field of Search ..... 135/65, 68, 70, 135/71, 72, 76, 910

[56] References Cited

U.S. PATENT DOCUMENTS

| | | | |
|---|---|---|---|
| 869,128 | 10/1907 | Autenrieth | 135/66 X |
| 2,225,114 | 12/1940 | Hoskins | 135/66 X |
| 2,580,888 | 1/1952 | Burkett | 135/66 |
| 3,363,639 | 1/1968 | Kurpis | 135/65 |
| 5,290,063 | 3/1994 | Lenhart | 135/76 X |
| 5,482,071 | 1/1996 | Liu | 135/66 |
| 5,566,700 | 10/1996 | Brown | 135/72 |
| 5,727,584 | 3/1998 | Stanec | 135/77 |

FOREIGN PATENT DOCUMENTS

| | | | |
|---|---|---|---|
| 542395 | 5/1993 | European Pat. Off. | 135/66 |
| 458915 | 4/1928 | Germany | 135/66 |

*Primary Examiner*—Carl D. Friedman
*Assistant Examiner*—Winnie S. Yip
*Attorney, Agent, or Firm*—Klaus J. Bach

[57] ABSTRACT

In a walking stick comprising a rod with a handle structure formed at one end of the rod, the handle structure includes a cylindrical opening receiving indicating or signaling instruments.

4 Claims, 2 Drawing Sheets

WALKING STICK

BACKGROUND OF THE INVENTION

The invention relates to a walking stick comprising a rod with a handle at one end thereof.

Walking sticks do not only serve as walking aids for older people, but they are also used as aids by hikers. They are often useful on difficult terrain when brush blocks the hiking path or when a steep trail has to be negotiated. But they are also useful on good trails in woods and meadows and even on city streets.

Walking sticks are also known to have bells or horns for generating warning signals. Such walking sticks are in demand particularly by young people who have been discharged from the army after finishing their duty. However, since these walking sticks are used generally only for a short period, the signal generating devices are attached on the walking stick only provisionally. Furthermore, they are so attached that they would be bothersome during an extended hiking tour.

For long hikes, a hiker generally takes measuring instruments along such as a watch, a compass or a thermometer. Those instruments are usually carried on the body or in pockets of his or her clothing. Carrying such instruments on the body has the disadvantage that the wristbands with which these instruments or usually attached to the body generate and collect sweat. This is generally quite uncomfortable for the hiker. Keeping the instrument in a pocket of a clothing piece has the disadvantage that the instrument has to be removed from the pocket for use. Furthermore, the storage of such instruments is problematic, if, for example, for a hike in the summer time, no clothing with pockets is worn by the hiker. Furthermore, for example a thermometer kept in a pocket would not indicate the correct air temperature.

It is the object of the present invention to provide a walking stick with instruments readily and neatly accommodated by the stick.

SUMMARY OF THE INVENTION

In a walking stick comprising a rod with a handle structure formed at one end of the rod, the handle structure includes a cylindrical opening receiving indicating or signaling instruments.

The retaining structure formed into the walking stick can ice readily accommodate any instrument provided therefor. For example, a watch, a compass, or a thermometer can be disposed in the retaining structure. But, instead of indicating instruments, the retaining structure can also accommodate signaling devices such as a reflector or electrically operated apparatus such as a horn. An energy source required for the operation of such electrically operated apparatus can be arranged within the handle of the walking stick. With the miniaturization achieved for electronic apparatus, it is also possible to arrange electronic equipment in the retaining structure such as a radio or an emergency transmitter. Particularly, the arrangement of an emergency transmitter in the retaining structure would be helpful to the hiker during an accident or if threatened by others. Such a device may even be life-saving.

The retaining structure is preferably arranged in the handle of the walking stick adjacent area of jointure between the rod and the handle. Then the indicating or signaling devices are in an area which is easily accessible for the hiker. Also, this area can be so shaped that sufficient space is available for the retaining structure and the arrangement has an appealing appearance.

The retaining structure preferably comprises a cylindrical cavity formed into the walking stick with a reinforcement wall extending across the cylindrical cavity at about half its length. With such a retaining structure, the indicating or signaling devices can easily be mounted. The retaining structure may be provided with clamping or engagement means by which the indicating or signaling device can be retained in the retaining structure. It is particularly advantageous if the indicating or signaling devices are cemented to the reinforcement wall. By cementing the instruments to the reinforcement wall, a secure connection is established by which the instruments become practically an integral part of the walking stick.

In a particular embodiment, the handle is an ergonomically shaped loop. Preferably, the handle has slot-like recesses which extend longitudinally on the surface of the loop and are separated by narrow webs. With its ergonomic shape, such a handle is comfortably disposed in the hikers hand and remains comfortable to use over a long period of time. With the slot-like recesses, furthermore, the skin of the hand is stimulated providing for a massaging effect. By a suitable arrangement of -the slot-like recesses, an effect can be obtained as it is achieved with acupressure devices by stimulating certain pressure points. This may be very beneficial to the well being of the hiker so that he does not feel tired even after long hikes.

Preferably, the handle consists of plastic material and is injection molded and provided with an extension extending into the rod where it is firmly engaged by engagement means molded onto the extension. In this way, the handle can be easily and inexpensively manufactured so that it has an appealing shape. The handle can then be combined with an appropriate rod adapted to the needs and taste of a particular hiker. This arrangement provides for relatively low manufacturing and storage costs. Since the mounting of the indicating or signaling instruments is also very simple a walking stick can be customized by the dealer in accordance with the needs and wishes of a customer. The dealer needs to keep only the various components in stock from which he can assemble a walking stick customized for a particular person. A large number of combinations can be generated from a relatively small amount of components. If the customer wishes, for example, a walking stick with reflectors such a walking stick can be just as easily be provided as a walking stick with for example, a watch and a thermometer.

In another embodiment of the invention, the walking stick is provided with a plate which serves as a seating surface. At one end, the plate is slidably supported on the walking stick. At the opposite end, two rod-like struts are pivotably attached to the plate and also to the walking stick.

During walking or hiking, the plate and the struts are disposed essentially in a plane with the walking stick or parallel thereto at a very small distance from the walking stick. Then the walking stick can still serve as a walking stick without being inhibited in its function.

When the struts are pivoted about their pivot axis, the plate is tilted out of the plane of the walking stick. With the tilting, the plate glides down along the stick until it is engaged by a stop provided on the stick. In this position, a tripod is formed by the walking stick, the two rod-like struts supporting on top the plate which extends then about horizontally. The tripod provides for a stable support structure for the plate which then forms a seating surface with good load capacity.

Preferably, the plate is provided with openings so that it can breathe. It is furthermore possible to arrange a retaining structure for instruments in the seat plate so that indicating or signaling instruments can be mounted also on the seat plate.

Further advantages and embodiments of the invention will be come apparent from the following description of an embodiment of the invention with reference to the accompanying drawings.

DESCRIPTION OF SAME EMBODIMENTS

Figure 1:
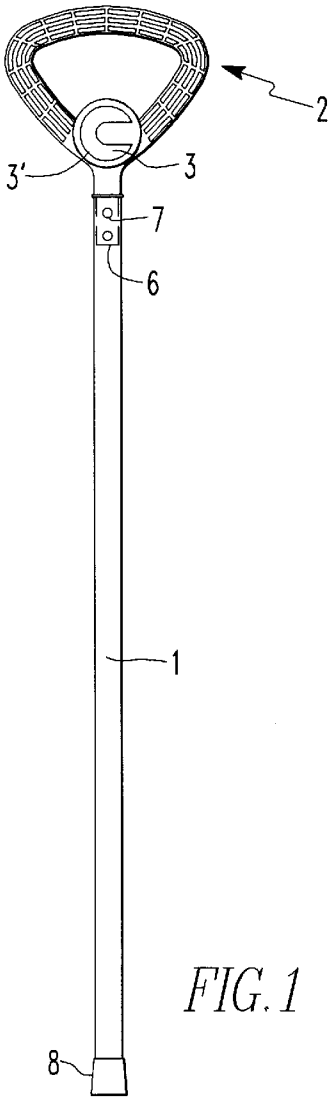
FIG. 1 shows a walking stick according to the invention.

As shown in FIG. 1, the walking stick comprises a rod 1 and a handle 2. The handle 2 is in the form of a closed loop which is shaped from an ergonomic point of view. Adjacent the rod 1, the handle 2 is provided with a pin 6 which extends into the interior of the rod 1. In the area of the pin 6, the rod 1 is provide with embossments 7 by which the handle 2 is firmly engaged with the rod 1.

Figure 2:
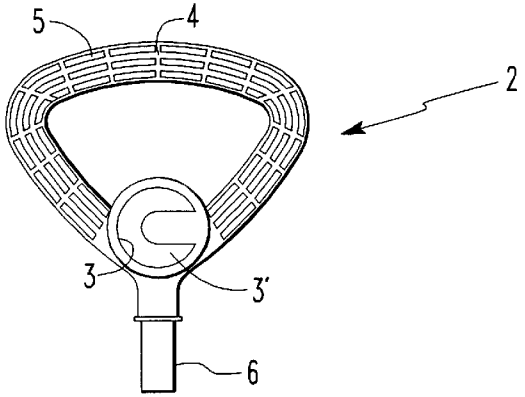
FIG. 2 is an enlarged view of the handle portion of the walking stick.

As it is apparent especially from FIG. 2, the handle 2 is provided, adjacent the stick 1, with an approximately triangular widened area from which the pin 6 extends. A mounting structure 3 is formed into the triangular widened area of the handle 2. The mounting structure comprises a cylindrical cavity extending transversely through the widened triangular area. A wall extends across the cylindrical cavity at about its axial center so that the cavity is closed, that is, cavities extend into the triangular widened area form opposite sides thereof.

The cylindrical cavities 3 receive appropriately shaped indicating or signaling instruments 3'. Since any type of instrument may be used the instrument is indicated only schematically in FIG. 2. The outer shape of the instrument corresponds to the shape of the cylindrical cavity 3 so that the instrument can be easily mounted in the cavity 3. For retaining the instruments in the cavity, they may be cemented for example onto the wall extending across the cavity 3.

The handle 2 includes slot-like recesses 4 extending longitudinally along the handle loop. The slot-like recesses 4 are separated by narrow webs 5. With the slot-like recesses 4, the handle 2 has a surface structure by which the hand of the user is massaged. The webs stimulate pressure points in the hand of the user which generate the same effects as acupressure or hand massages. Furthermore, the groove-like recesses permit the passage of air, or with varying hand pressure promote the passage of air, so that the hand surface is kept dry during use of the walking stick.

At its end remote from the handle 2, the walking stick is provided with a rubber socket 8 which makes the use of the walking stick on rough surfaces more comfortable.

Figure 5:
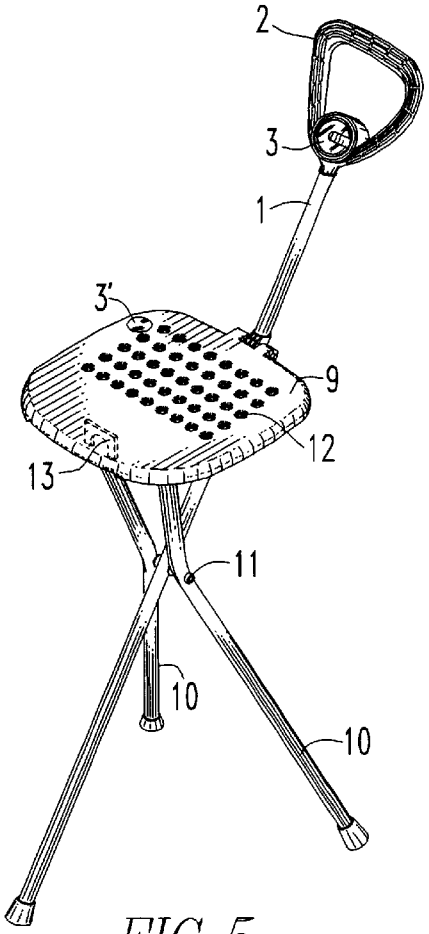
FIG. 5 is a perspective view of the the walking stick with seating plate in an unfolded state.
Figure 4:
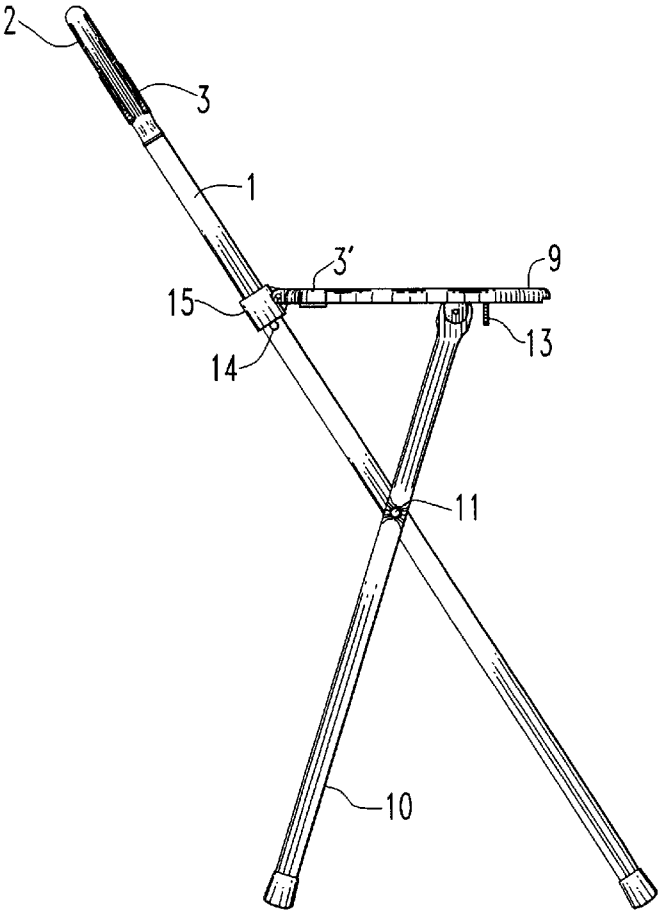
FIG. 4 shows the walking stick with the seating plate unfolded.
Figure 3:
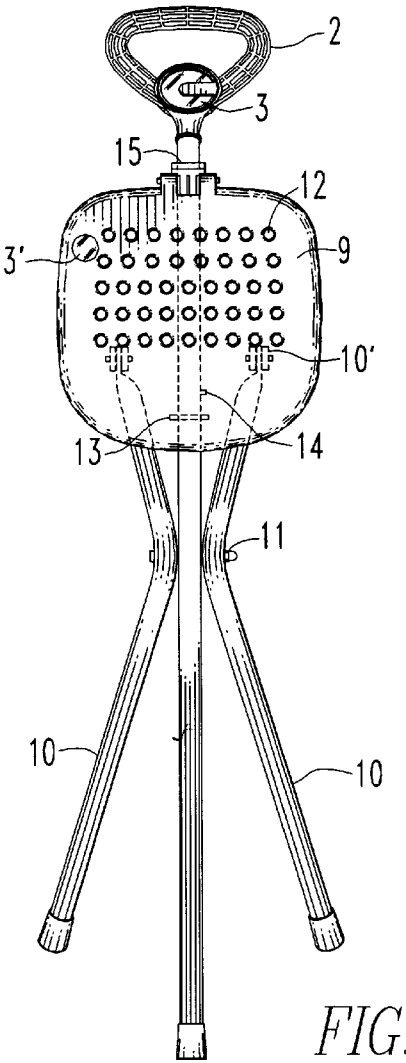
FIG. 3 shows a walking stick including a seating plate in a folded state.

In an embodiment as shown in FIGS. 3, 4 and 5, the walking stick is provided with a seat plate 9, which at its rear end is slidably supported on the rod 1. Two struts 10 are pivotally mounted on the rod 1 by a support shaft 11 and are pivotally connected at one end 10' to the seat plate 9. The seat plate 9 includes a series of passages 12 permitting the flow of air therethrough. For retaining the seat in its retracted position as shown in FIG. 3, the seat is provided with a clamping structure 13 for firm engagement of the seat with the rod 1 alongside the rod 1. In this manner, the walking stick can be safely used as walking stick without the seat plate coming loose.

For unfolding the seat plate, the rod 1 is released from the clamping structure 13 by an appropriate disengagement force. The seat plate then slides down along the rod 1 while the two struts 10 pivot away from the rod 1 about the support shaft 11. The seat plate 9 slides down along the rod 1 on a tubular slide member 15 to which the seat is linked until the slide member 15 is seated on a stop 14 provided on the rod 1, in which position the seat plate 9 is disposed about horizontally. The rod 1 with the handle 2 and the struts 10 then form a tripod supporting on top the seat plate 9.

As indicated in FIGS. 3–5 a mounting structure for an instrument may not only be provided in the handle portion 2 but also in the seat itself as shown by reference numeral 3".

What is claimed is:

1. A walking stick comprising a rod and a loop-shaped handle structure joined to said rod at one end of said rod, said handle structure including cylindrical openings extending into said handle structure from opposite sides thereof in the area of jointure of said rod and handle structure with a wall extending centrally between said cylindrical openings at the opposite sides of said handle structure and indicating or signaling instruments being disposed in said openings and attached to said wall.

2. A walking stick according to claim 1, wherein said loop-shaped handle includes slot-like recesses which extend circumferentially along said handle separated by narrow webs.

3. A walking stick according to claim 1, wherein said handle consists of plastic material which is injection-molded and includes an extension which is received in said rod and engaged therein by embossments.

4. A walking stick according to claim 1, wherein, in the area adjacent said rod, said handle includes a triangularly shaped structure in which said cylindrical opening is formed.

* * * * *